US005398605A

United States Patent [19]

Tokiwa

[11] Patent Number: 5,398,605

[45] Date of Patent: Mar. 21, 1995

[54] INK PUMP CONTROL SYSTEM

[75] Inventor: Shizuro Tokiwa, Zushi, Japan

[73] Assignee: Tokyo Kirai Seisakusho, Ltd., Tokyo, Japan

[21] Appl. No.: 234,568

[22] Filed: Apr. 28, 1994

[30] Foreign Application Priority Data

Aug. 18, 1993 [JP] Japan ..... 5-203831

[51] Int. Cl.[6] ..... B41F 31/08

[52] U.S. Cl. ..... 101/366; 417/18

[58] Field of Search ..... 101/366, 365, 350, 207–210, 101/363, 364, 147, 148; 417/410 R, 1, 5, 18, 22, 24; 318/696

[56] References Cited

U.S. PATENT DOCUMENTS 3,737,251 6/1973 Berman et al. ..... 417/12
3,746,957 7/1973 Forster et al. ..... 318/696
4,281,597 8/1981 Dressler ..... 101/366 X

FOREIGN PATENT DOCUMENTS 174446 11/1989 Japan .
174447 11/1989 Japan .

*Primary Examiner*—J. Reed Fisher
*Attorney, Agent, or Firm*—McGlew and Tuttle

[57] ABSTRACT

An ink pump control system driven by a stepping motor comprising a pulse generating section for generating stepping motor driving pulses, an arithmetic section for obtaining a time difference $\Delta t = T_2 - T_1$ between the time $T_2$ and time $T_1$ required to cause the stepping motor to rotate in angular movements at a hypothetical revolution speed $r_2$ required for feeding ink and a predetermined revolution speed $r_1$ based on printing speed data and printing element ratio data, a predetermined pulse output section for outputting pulses that cause the stepping motor to rotate intermittently at high speed based on the pulses generated by the pulse generating section and the time difference $\Delta t$ obtained in the arithmetic section, and an excitation signal output section for outputting an exciting signal to cause the stepping motor to be actuated by a motor driver.

7 Claims, 5 Drawing Sheets

OUTPUT PULSE SHAPE OF BASIC PULSE OUTPUT SECTION 8

OUTPUT PULSE SHAPE OF PREDETERMINED PULSE OUTPUT SECTION 5

OUTPUT PULSE SHAPE OF PREDETERMINED PULSE OUTPUT SECTION 5

INK PUMP CONTROL SYSTEM

BACKGROUND OF THE INVENTION AND RELATED ART STATEMENT

This invention relates generally to an ink pump control system for controlling ink feed in an ink feeder installed on various types of printing presses, and more specifically to an ink pump contrôl system for controlling ink feed by controlling the revolution of a stepping motor as the drive unit of the ink feeder in accordance with printing speed and printing element ratio (the ratio of printing element area to the sum of a printing element area and a non-printing area on the surface of an object to which ink is fed.)

There exist various types of ink feeders for feeding ink to printing presses for printing newspaper and other printed matter. There is publicly known a typical construction of ink feeder in which an ink pump installed on a printing press is driven by a stepping motor, and ink feed is changed by controlling the revolution of the stepping motor in accordance with each input data of printing speed, printing element ratio and printing density. (Refer to Japanese Published Unexamined Patent Publication No. Hei-1(1989)-174446 and Japanese Published Unexamined Patent Publication No. Hei-1(1989)-174447, for example.)

In the aforementioned publicly known ink pump control system, a frequency division ratio for dividing a basic clock frequency (oscillation frequency) is obtained based on each input data of printing speed, printing element ratio and printing density, and pulses obtained by dividing the basic clock at the frequency division ratio are applied to the stepping motor as the drive unit of the ink pump to effect control so that the optimum ink feed at a given moment can be obtained in accordance with the printing state at that moment.

In the conventional construction where the basic clock frequency is divided at a frequency division ratio obtained by arithmetic operation, and the resulting frequency-divided pulses are applied to a stepping motor, the stepping motor is always kept in a state excited by the frequency-divided pulses of more than zero and less than the basic clock frequency.

This excited state may cause resonance in the stepping motor when rotated at a low revolution, which could in turn produce vibration or shorten the service life of an ink pump driven by the stepping motor.

Furthermore, the coils of the stepping motor are also kept excited even in cases where the ink pump need not be operated as there is no need for ink feeding, or where the printing press is temporarily idled, that is, where printing speed is zero, or where the stepping motor is stopped due to the absence of printing elements on the plate surface to which ink is fed. This may waste electitc power, leading to the reduced life of the stepping motor and increased running cost.

SUMMARY OF THE INVENTION

It is an object of this invention to provide an ink pump control system that is adapted to cause the stepping motor to be rotated intermittently at high speed, and suspend the excitation of the stepping motor coils when the ink pump need not be operated because printing speed is zero or less than a predetermined speed, or because printing element ratio is zero or almost zero, thereby preventing the stepping motor from resonating to avoid generating noise and reducing the life of the related equipment.

It is a further object of this invention to provide an ink pump control system which can eliminate waste of power and any unnecessary loads on the stepping motor, thereby reducing running cost.

DETAILED DESCRIPTION OF THE EMBODIMENT

Figure 1:
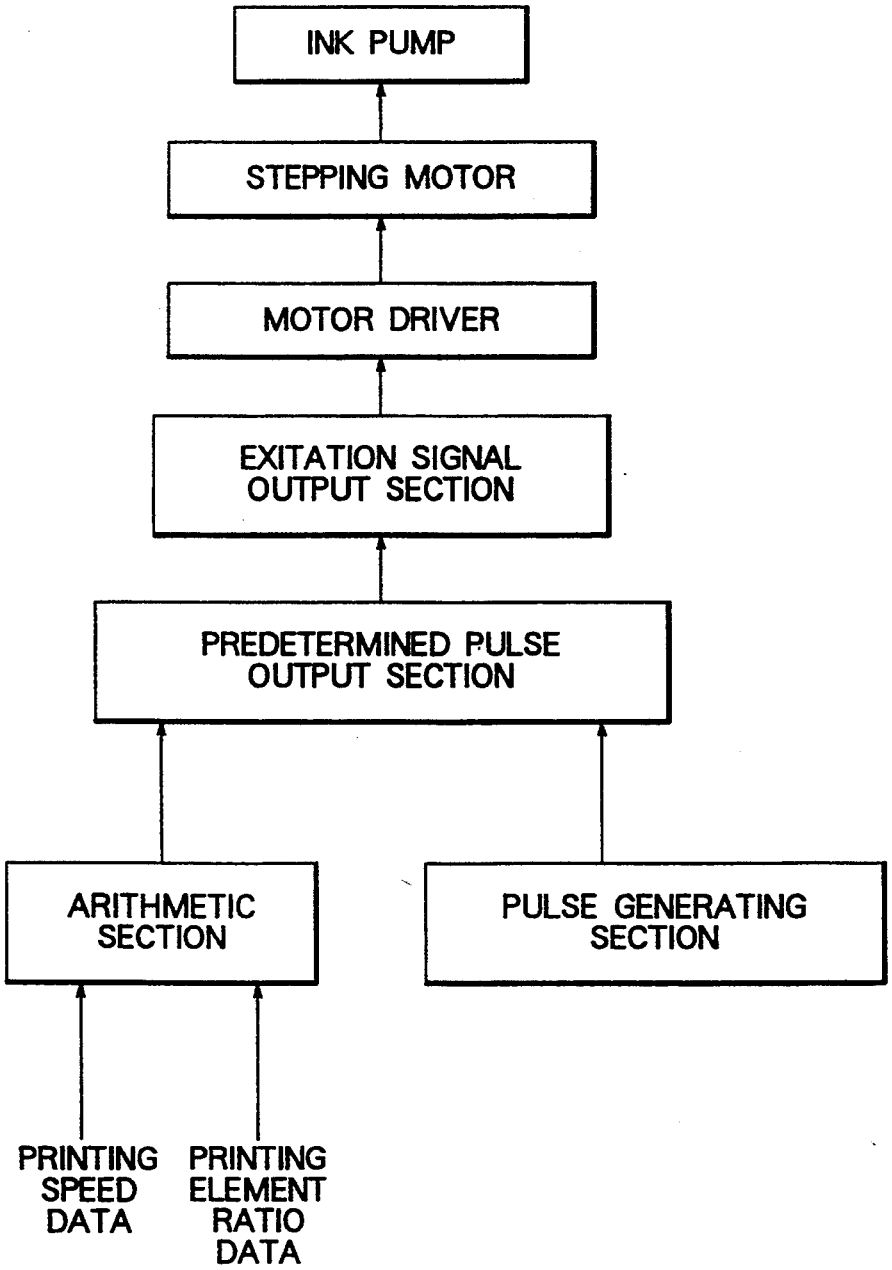
FIG. 1 is a block diagram illustrating an outline of the basic configuration of this invention.

FIG. 1 is a block diagram illustrating an outline of the basic configuration of this invention. In FIG. 1, reference numeral 1 designates an ink pump that is controlled so that ink is fed to the printing press in accordance with printing speed and printing element ratio, and 2 a stepping motor that drives the ink pump 1.

Reference numeral 3 designates an arithmetic section, to which data on the printing speed for a printing operation and data on the printing element ratio on a plate surface to which ink is fed for the printing operation are inputted.

The data on printing speed involves the number of output pulses per unit time in the pulse output section operating in conjunction with a printing press drive section, for example, or the number of revolutions of a plate cylinder, etc. per unit time obtained based on the number of output pulses, and the data on printing element ratio involves the printing element ratio value obtained by scanning a graphic arts film, for example, or the ink feed correction factor obtained based on the printing element ratio.

The arithmetic section 3 calculates a hypothetical revolution speed $r_2$ of the stepping motor 2 required for feeding ink for the printing operation based on the input data, and then further calculates time $T_2$ required for causing the stepping motor 2 to rotate by a predetermined angular step a at the hypothetical revolution speed $r_2$ to perform an arithmetic operation to obtain the time difference $\Delta t = T_2 - T_1$ from the time $T_2$ and time $T_1$ required to cause the stepping motor 2 to rotate by the angular step a at a predetermined revolution speed $r_1$ ($r_1 \geqq r_0$) that is higher than a revolution speed $r_0$ required for feeding the maximum amount of ink.

Reference numeral 4 designates a pulse generating section that generates basic pulses of a frequency to cause the stepping motor 2 to rotate at a predetermined revolution speed $r_1$ higher than a revolution speed $r_0$ required to feed the maximum amount of ink and frequency-divided pulses obtained by frequency-dividing the basic pulses. Examples of applications of the frequency-divided pulses will be described later in more detail in the description of an embodiment.

Reference numeral 5 designates a predetermined pulse output section that repeats the outputting of pulses needed to cause the stepping motor 2 to rotate in the angular steps of a predetermined angle a and the suppression of pulse outputs for a duration equal to the aforementioned time difference $\Delta t$.

Reference numeral 6 designates an excitation signal output section that generates an excitation signal to the motor coil of each phase of the stepping motor 2 based on outputs from the predetermined pulse output section 5.

Reference numeral 7 designates a motor driver that amplifies the power of the excitation signals outputted by the excitation signal output section 6 to feed an excitation current to the motor coil of the corresponding phase.

The stepping motor 2 performs an intermittent movement repeating angular displacements at the aforementioned predetermined high-speed revolution speed $r_1$ and pause periods to effect the same number of revolutions as the hypothetical revolution speed per unit time $r_2$. The ink pump 1 in the printing operation performs the same ink feeding as is driven by the stepping motor 2 that operates at the hypothetical revolution speed $r_1$. That is, the ink pump 1 feeds the required amount of ink for that printing operation.

The stepping motor 2, which repeats the state of high-speed revolution and the state of idling, does not undergo the state of low-speed revolution, eliminating unwanted resonance associated with low-speed revolution. Thus, resonance-induced noise can be prevented, and the life of the stepping motor 2 can be prevented from being shortened.

Figure 2:
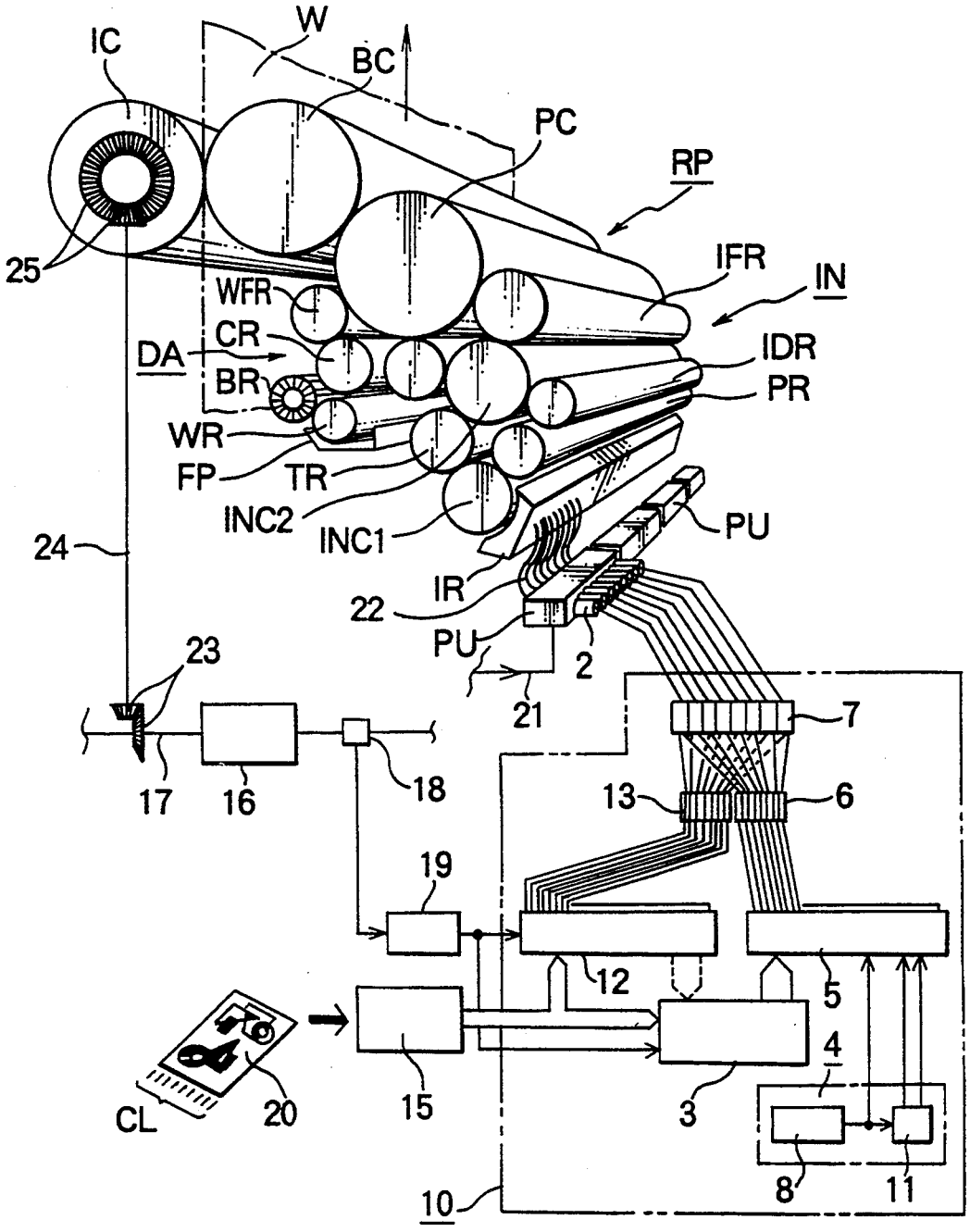
FIG. 2 is a diagram of assistance in explaining am embodiment where this invention is applied to a newspaper offset press.

FIG. 2 is a diagram of assistance in explaining an embodiment in which this invention is applied to a newspaper offset press. Like numerals indicate like parts shown in FIG. 1. In FIG. 2, a rotary printing press RP causes a web W to travel in the direction shown by an arrow between an impression cylinder IC and a blanket cylinder BC while feeding ink to a printing plate (not shown) attached to a plate cylinder PC via an inker assembly IN so as to transfer printing elements on the plate onto the web W via the blanket cylinder BC.

The inker assembly IN comprises a first ink cylinder INC1, a pen roller PR and an ink transfer roller TR, both revolving in contact with the first ink cylinder INC1, a second ink cylinder INC2 revolving in contact with the ink transfer roller TR, an ink form roller IFR and an ink distributing roller IDR, both revolving in contact with the second ink cylinder INC2, an ink rail IR for feeding ink to the first ink cylinder INC1, and an ink pump unit PU driven by the stepping motor 2.

Symbol DA designates a dampening arrangement comprising a fountain pan FP, a water fountain roller WR, a brush roller BR, a chromium-plated roller CR, and a water form roller WFR for continuously feeding dampening water uniformly on the non-printing element area on the plate cylinder PC.

A printing plate of the size of eight newspaper pages (four pages in the axial direction and two pages in the circumferential direction), for example, can be attached to the plate cylinder PC, and the plate area is divided in the axial direction into eight areas or columns for each page of newspaper; with an ink pump being allocated to each column. Thus, eight ink pumps are assembled into an ink pump unit PU that feeds ink across the width of a newspaper page on the plate cylinder PC. The suction side of the ink pump unit PU is connected to an ink tank (not shown) via a pipe 21, while the delivery side thereof is connected to the ink rail IR via a pipe 22.

Each ink pump of the ink pump unit PU has a driving stepping motor 2, which is a motor having 200 steps (angular step: 1.8 degree) per revolution, for example. The stepping motor 2 is designed to achieve rotation at a revolution speed $r_0$ required to drive an ink pump of 120 rpm, for example, so as to feed the maximum required amount of ink for a given printing operation, that is, a necessary and sufficient amount of ink for a column having the maximum printing element ratio (100%) in a printing operation involving the maximum printing speed.

In the interests of simplicity, the stepping motor 2 of one ink pump unit PU is illustrated in the figure. The control system 10, which will be described later, is also illustrated only that for one ink pump unit PU.

Numeral 16 designates a main motor that is adapted to drive the rotary printing press RP, including the impression cylinder IC, via a driving main shaft 17, a bevel gear 23, a driving shaft 24 and a bevel gear 25.

Numeral 20 designates a graphic arts film corresponding to a newspaper page, for example. The printing element ratio on the graphic arts film 20 for each column CL divided into eight areas in the across-the-width direction is measured by appropriate printing element ratio measuring means (not shown) and inputted into input means 15.

A control system 10 comprises an arithmetic section 3, a pulse generating section 4, a predetermined pulse output section 5, an excitation signal output section 6, a motor driver 7 and a basic pulse output section 8. A frequency division section 11, a comparator section 12 and a power feed suspending section 13 are provided in the control system 10.

In FIG. 2, numeral 18 designates a pulse output section, and 19 an operating speed sensor section.

The basic pulse output section 8 continually outputs basic pulses of such a frequency as to cause the stepping motor 2 to rotate at a revolution speed higher than the revolution speed $r_0$ needed to feed the maximum amount of ink for the printing operation, or of 1 kHz, for example.

In the arithmetic section 3 inputted is the data on printing speed through the pulse output section 18 and the operating speed sensor section 19 linked to the driving main shaft 17 driven by the main motor 16, for example. The data on the printing element ratio on the graphic arts film 20 acquired by appropriate means, or the data on ink feed correction factor obtained from FIG. 3, which will be described later, based on the aforementioned printing element ratio data is inputted from an input section 15 to the arithmetic section 3. The arithmetic section 3 calculates as a hypothetical revolution speed $r_2$ the revolution speed required for the stepping motor 2 to drive the ink pump to feed the required amount of ink for the printing operation, and further calculates the time $T_2$ required to cause the stepping motor 2 to rotate by the angular step of a predetermined angle $\alpha$, or of 90 degree, for example, at the hypothetical revolution speed $r_2$.

The arithmetic section 3 also calculates time difference $\Delta t = T_2 - T_1$ by subtracting the time $T_1$ required for the aforementioned angular displacement of a predetermined angle, 90 degree, for example, that is, a predetermined time $T_2$ required for a predetermined pulse being outputted, from the time $T_2$ calculated above.

The predetermined pulse output section 5 repeats the operation of outputting pulses for causing the stepping motor 2 to rotate in angular steps of a predetermined angle a, that is, pulses of such a predetermined shape as to continually operate the stepping motor 2 in 50 steps, for example, and subsequently suspending pulse outputting for a period of time equal to the time difference Δt, based on the basic pulses inputted and the calculated time difference Δt.

Figure 5A:
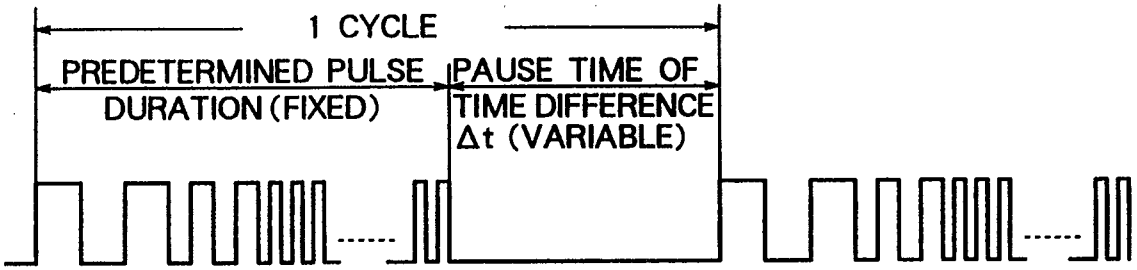
FIGS. 5A and 5B are diagrams illustrating examples of output pulse shapes from the predetermined pulse output section 5 shown in FIG. 2.

The pulses of a predetermined shape outputted by the predetermined pulse output section 5, that is, the predetermined pulses, may consist of only the basic pulses outputted by the basic pulse output section 8, but usually have such a configuration that the first several pulses of the predetermined pulses outputted are the frequency-divided pulses inputted the frequency division section 11, as shown in FIG. 5A because starting the stepping motor 2 with higher-frequency pulses only could result in uneven operation due to the inertial force caused by the rotor, etc.

The excitation signal output section 6 operates the stepping motor 2 by outputting an excitation signal for phase-exciting the stepping motor 2 in accordance with the predetermined pulses and amplifying power via the motor driver 7. In this embodiment, an excitation signal of a single-two phase excitation system is outputted to ensure excellent transient characteristics in the operation of the stepping motor 2.

Figure 3:
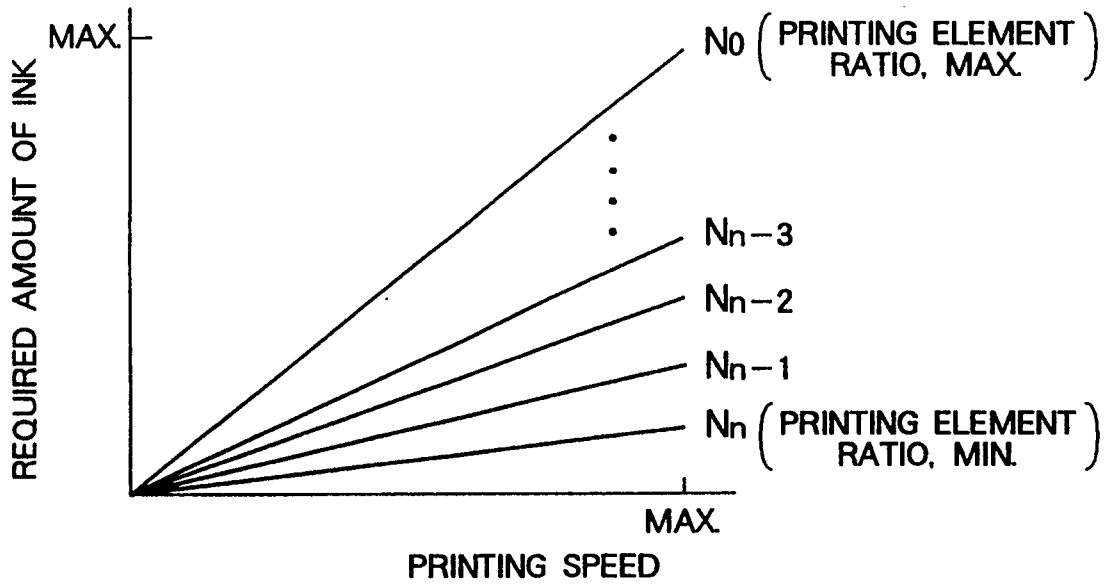
FIG. 3 is a diagram illustrating the relationship between printing speed and the ink feed correction factor, and the required amount of ink.

In the comparator section 12, inputted is the data on printing speed and the data on printing element ratio on the graphic arts film 20, for example, obtained by appropriate means, or the data on ink feed correction factor obtained from FIG. 3 based on the aforementioned printing element ratio data, as in the case of the arithmetic section 3. The comparator section 12 compares these data to check to see if each of them satisfies its predetermined printing conditions, for example, if its printing speed is less than a predetermined level, or if its printing element ratio is zero or almost zero. The comparator section 12 then outputs an actuating signal to the power feed suspending section 13 when at least any one of these data agrees with the printing conditions.

The comparator section 12 may be provided independently by incorporating in the arithmetic section 3.

The power feed suspending section 13 suspends the feeding of power to the motor driver 7 in accordance with the signal outputted by the comparator section 12 so that the stepping motor 2 is prevented from being excited, regardless of the presence or absence of the signal output of the excitation signal output section 6.

FIG. 3 is a diagram illustrating the relationship between printing speed and ink feed correction factor, and the required amount of ink. In FIG. 3, symbols $N_0$–$N_n$ designate ink feed correction factors, as determined by the printing element ratio on a plate surface to which ink is to be fed. These ink feed correction factors are set in advance in (n+1) stages by dividing the range from $N_0$ representing the maximum printing element ratio to $N_n$ representing the minimum printing element ratio into n equal parts.

Consequently, when a printing element ratio for a printing operation is determined by a graphic arts film 20 shown in FIG. 2, the ink feed correction factor corresponding to it can be obtained. Thus, the required amount of ink is proportional to a printing speed, and with the constant printing speed, the higher the printing element ratio is, the larger becomes the required amount of ink.

Figure 4:
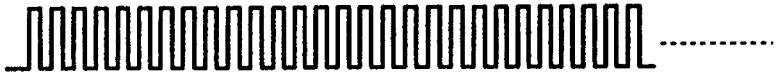
FIG. 4 is a diagram of assistance in explaining an example of output pulse shapes from the basic pulse output section 8 shown in FIG. 2.

FIG. 4 is a diagram of assistance in explaining an example of output pulse shape of the basic pulse output section 8, as shown in FIG. 2. The basic pulse output section 8 outputs square basic pulses of 1 kHz, for example to the predetermined pulse output section 5 and the frequency division section 11.

Figure 5B:
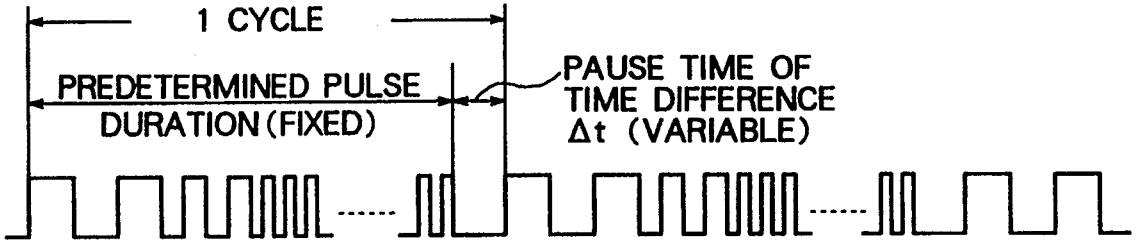

FIGS. 5A and 5B are diagrams illustrating examples of output pulse shapes of the predetermined pulse output section 5 shown in FIG. 2. As will be described later, the predetermined pulse output section 5 outputs pulses produced by combining the basic pulses outputted by the basic pulse output section 8 with a plurality of frequency-divided pulses produced by the frequency division section 11. The duration of the predetermined pulses for operating the stepping motor 2, and the pause time of time difference Δt for idling the stepping motor 2 constitute one cycle, with the predetermined pulses duration being fixed, and the pause time of time difference Δt being variable. The pulses shown in FIG. 5A have a longer pause time of time difference Δt than that shown in FIG. 5B, requiring longer time for executing one cycle.

Figure 6:
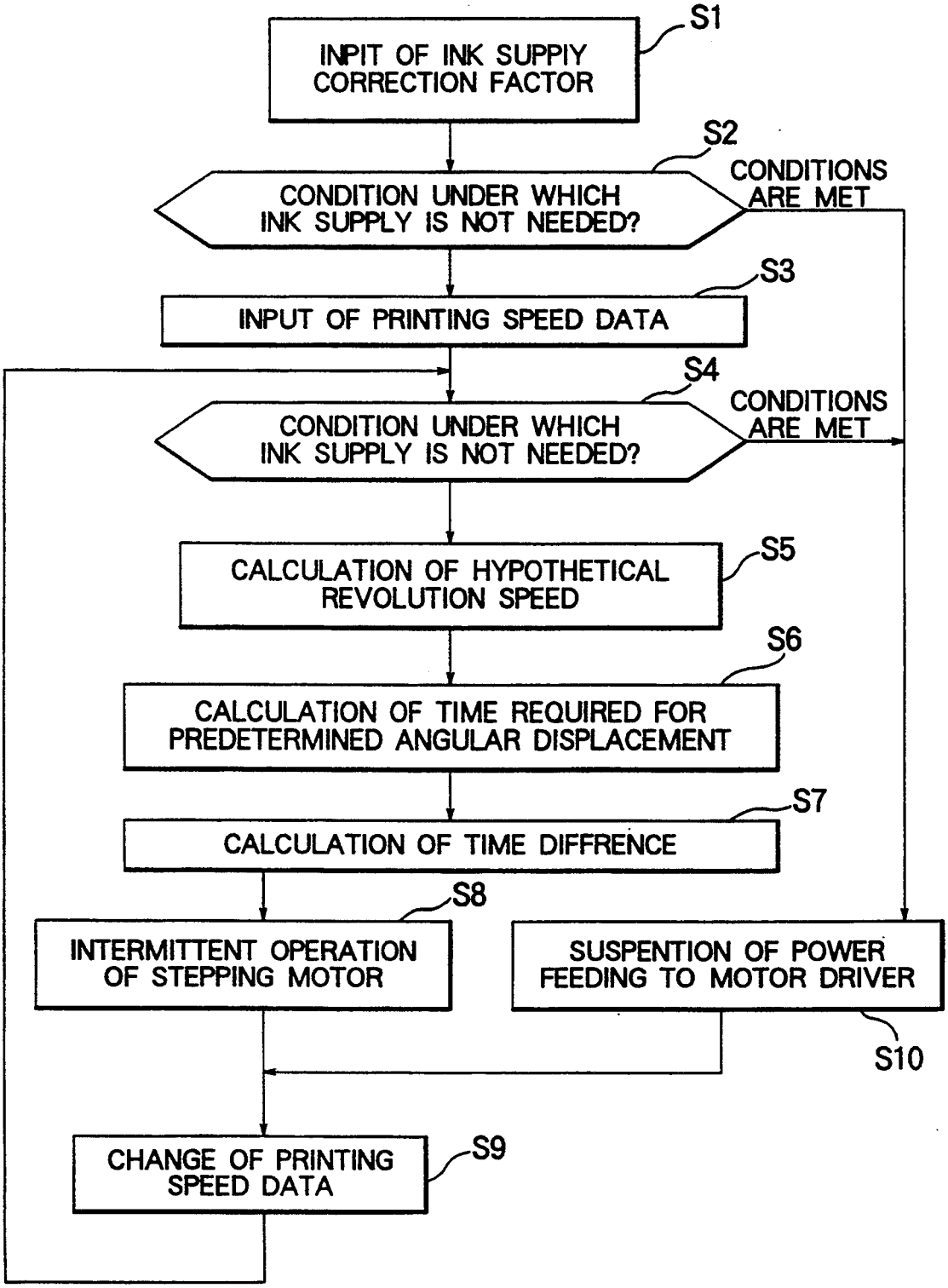
FIG. 6 is a flow chart illustrating an example of control procedures for the ink pump of the embodiment of the invention.

In the following, the operation of an embodiment shown in FIG. 2 will be described, referring to the flow chart of FIG. 6.

First, an ink feed correction factor (see FIG. 3) corresponding to a printing element ratio for each column is inputted from the input section 15 (Step S1).

In a configuration having the comparator 12, the ink feed correction factor inputted is checked to see if it is data corresponding to the printing element ratio of 0 (Step S2). If it is the data corresponding to the printing element ratio of 0, the power feed suspending section 13 is operated to suspend power feeding to the motor driver 7 (Step S10), and control is effected so as to prevent the excitation of the stepping motor that drives the ink pump to feed ink to the columns. Next, as the rotary printing press RP starts operating, data on printing speed, such as the revolution speed of the plate cylinder PC is inputted via the operating speed sensor section 19 (Step S3). In the configuration with the comparator section 12, the comparator section 12 checks to see if the plate cylinder revolution speed is less than a predetermined value (Step S4). If it is less than the predetermined value, the power feed suspending section 13 is operated to suspend power feeding to the motor driver 7 (Step S10), and control is effected so as to prevent the excitation of the stepping motor 2 that drives the ink pump.

In a configuration without the comparator section 12, or in a configuration with the comparator section 12, either of whose link feed correction factor or plate cylinder revolution speed does not agree with predetermined conditions, the operating sequence proceeds to Step 5, and the arithmetic section 3 calculates the hypothetical revolution speed $r_2$ of the stepping motor 2 using the following equation.

$$r_2 = r_0 \cdot (R \cdot N)/(R_0 \cdot N_0)$$

where N: ink feed correction factor, R: plate cylinder revolution speed, $R_0$: plate cylinder revolution speed at the maximum printing speed, $N_0$: ink feed correction factor corresponding to the maximum printing element ratio, and $r_0$: revolution speed of the stepping motor 2 to feed the maximum required amount of ink.

Furthermore, the time $T_2$ required for an angular displacement of a predetermined angle a at a hypothetical revolution speed $r_2$ is calculated using the following equation (Step S6).

$$T_2=(60/r_2)/(360/\alpha)$$

The arithmetic section 3 then calculates the time difference $\Delta t$ between the time $T_2$ obtained above and the time $T_1$ required for the predetermined pulse to cause the stepping motor 2 to rotate by an angle a using the following equation (Step S7).

$$\Delta t=T_2-T_1$$

Substituting into the above equation appropriate values suitable for the aforementioned embodiment, such as $R_0=625$ rpm, $N_0=44$, $r_0=120$ rpm, $R=500$ rpm and $N=11$, yields $r_2=24$ rpm. Substituting $a=90°$ yields $T_2=0.625$ sec.

When the stepping motor 2 is driven by an excitation signal of the aforementioned single-two phase system, on the other hand, one pulse causes the stepping motor 2 by a 0.5 angular step. In this embodiment, therefore, the number of pulses needed to cause the stepping motor 2 to rotate a full turn is 400.

Thus, the number of pulses needed to the angular displacement of a predetermined angle of 90 degrees is 100 pulses per cycle.

To ensure smooth start, these pulses have a predetermined pulse mix comprising several pulses of different frequencies obtained by dividing by the frequency division section 11 the basic pulse of a frequency of 1 kHz generated by the basic pulse output section 8 in the pulse generating section 4; a pulse mix having sequentially arranged a total of 100 pulses consisting of one pulse having a frequency of 100 Hz, two 200-Hz pulses, five 500-Hz pulses, and 92 1-kHz pulses, for example. With this predetermined pulse mix, the time $T_1$ required for outputting 100 pulses in one cycle is 0.12 sec, which is a favorable level because it is less than 0.125 sec, the time required for the stepping motor 2 to make a 90° angular displacement at a revolution speed $r_0$ to feed the maximum required amount of ink.

Consequently, by substituting $T_1=0.122$, $\Delta t'T_2-T_1=0.503$ sec.

The predetermined pulse output section 5 then repeats the operation of outputting the predetermined pulses consisting of the basic pulses outputted by the basic pulses output section 8 and the frequency-divided pulses obtained by dividing the frequency of the basic pulses, and subsequently suspending pulse outputting for a period of time equivalent to the time difference $\Delta t$ obtained by the arithmetic section 3.

The excitation signal output section 6 outputs excitation signals in accordance with the predetermined pulses and amplifies power via the motor driver 7 to cause the stepping motor 2 to operate intermittently while taking the pause time obtained based on the calculation results for each stepping motor (Step S8).

During this intermittent operation, the revolution per unit time of the stepping motor 2 becomes equal to the revolution per unit time when continuously operated at the hypothetical revolution speed $r_0$ obtained by the arithmetic section 3. This enables the ink pump to be operated in a similar manner to that driven by the stepping motor 2 rotating at the hypothetical revolution speed $r_0$ to ensure the Feeding of the required amount of ink.

Next, when a change of the data on printing speed is inputted from the input section 15, the processings of Step S9, Step S4 through Step S8 or Step S10 are repeated.

Although the control system 10 comprises discrete circuits in the embodiment, the same operations can be accomplished using a microprocessors instead of individual circuits, or devices other than the motor driver 7 may be replaced with microprocessors.

In this embodiment, description has been made on the so-called half-deck type printing press in which the impression cylinder IC is forced in contact with the blanket cylinder BC, as shown in FIG. 2, to print only on one surface of the web W. This invention, however, may be applied to the so-called B—B (blanket to blanket) type where another blanket cylinder is provided in place of the impression cylinder IC shown in FIG. 2, and another set of the plate cylinder and the inker assembly is provided on this blanket cylinder to cause the web W to travel between these two blanket cylinders coming in contact with each other, or to the spotted B—B type, or the half-deck B—B type or the satellite type printing press.

Furthermore, this invention may be applied not only to the offset printing press, as described above, but to that of the direct printing system, or of the lithograph, or the anastatic, or the intaglio or the mimeographic system.

As an ink pump constituting the ink pump unit, the plunger pump, the piston pump, the injection pump, the gear pump, the screw pump,vane pump and other known pumps may be used.

As described above, this invention enables the stepping motor to be operated in a high-speed intermittent operation with predetermined pulses, with the stepping motor rotation time representing the period of the predetermined pulses being fixed, and the stepping motor idling time representing the time-difference $\Delta t$ period being variable. As a result, low-speed rotation and resonance associated with it can be eliminated, thereby noises caused by vibration can be prevented. Thus, the service life of the stepping motor or the ink pump can be prevented from being shortened due to vibration.

By providing a power feed suspending section, the power fed to the stepping motor can be interrupted when ink feed is needed, that is, when the ink pump need not be operated. This leads to reduction in power waste, and reduces unnecessary loads to the stepping motor, preventing the life of the stepping motor from being shortened, contributing to reduction in running cost.

What is claimed is:

1. An ink pump control system that is driven by a stepping motor and can feed the maximum required amount of ink by causing said stepping motor to rotate at a revolution speed $r_0$ under a printing condition involving the maximum revolution speed and the maximum printing element ratio, characterized in that said ink pump control system comprises a pulse generating section for generating pulses to cause the stepping motor to rotate, an arithmetic section for calculating, based on data on printing speed for a printing operation and data on printing element ratio of said printing operation, a hypothetical revolution speed $r_2$ of said stepping motor required for feeding ink for said printing operation, time $T_2$ required for said stepping motor to accomplish an angular displacement by a predetermined angle $\alpha$ at said hypothetical revolution speed $r_2$, and a time difference $\Delta t = T_2 - T_1$ by subtracting from said time $T_2$ time $T_1$ required for said stepping motor to accomplish an angular displacement by a predetermined angle $\alpha$ at a predetermined revolution speed $r_1$ higher than said revolution speed $r_0$ required for feeding the maximum required amount of ink, a predetermined pulse output section for outputting pulses necessary for causing said stepping motor to accomplish an angular displacement by a predetermined angle $\alpha$ based on pulses generated by said pulse generating section and said time difference $\Delta t$ obtained by said arithmetic section, and subsequently suspending the outputting of pulses equal to said time difference $\Delta t$, and an excitation signal output section for outputting excitation signals in accordance with outputs from said predetermined pulse output section to operate said stepping motor via a motor driver so that said ink pump is controlled by the intermittent high-speed rotation of said stepping motor.

2. An ink pump control system as set forth in claim 1 wherein said pulse generating section comprises a basic pulse output section for generating basic pulses and a frequency division section for dividing the frequency of said basic pulses so that said stepping motor is operated intermittently at high speed via said predetermined pulse output section, based on predetermined pulses consisting of frequency-divided pulses and said basic pulses and said time difference $\Delta t$.

3. An ink pump control system as set forth in claim 2 wherein said predetermined pulse output section is adapted to generate predetermined pulses consisting of pulses arranged in the descending order of period, using said basic pulses and a plurality of types of said frequency-divided pulses having different periods.

4. An ink pump control system that is driven by a stepping motor and can feed the maximum required amount of ink by causing said stepping motor to rotate at a revolution speed $r_0$ under a printing condition involving the maximum revolution speed and the maximum printing element ratio, characterized in that said ink pump control system comprises a pulse generating section for generating pulses to cause the stepping motor to rotate, an arithmetic section for calculating, based on data on printing speed for a printing operation and data on printing element ratio of said printing operation, a hypothetical revolution speed $r_2$ of said stepping motor required for feeding ink for said printing operation, time $T_2$ required for said stepping motor to accomplish an angular displacement by a predetermined angle $\alpha$ at said hypothetical revolution speed $r_2$, and a time difference $\Delta t = T_2 - T_1$ by subtracting from said time $T_2$ time $T_1$ required for said stepping motor to accomplish an angular displacement by a predetermined angle $\alpha$ at a predetermined revolution speed $r_1$ higher than said revolution speed $r_0$ required for feeding the maximum required amount of ink, a predetermined pulse output section for outputting pulses necessary for causing said stepping motor to accomplish an angular displacement by a predetermined angle a based on pulses generated by said pulse generating section and said time difference $\Delta t$ obtained by said arithmetic section, and subsequently suspending the outputting of pulses equal to said time difference $\Delta t$, and an excitation signal output section for outputting excitation signals in accordance with outputs from said predetermined pulse output section to operate said stepping motor via a motor driver, a comparator section for comparing data on printing speed for said printing operation and data on printing element ratio inputted to said arithmetic section with predetermined conditions for printing speed and printing element ratio under which ink feed is not needed, and outputting a signal when at least any one of both data agrees with said conditions under which ink feed is not needed, and a power feed suspending section for suspending power feed to said motor driver based on said signal outputted by said comparator section so that said ink pump is controlled by the intermittent high-speed rotation of said stepping motor.

5. An ink pump control system as set forth in claim 4 wherein said pulse generating section comprises a basic pulse output section for generating basic pulses, and a frequency division section for dividing the frequency of said basic pulses so that said stepping motor is caused to rotate intermittently at high speed with predetermined pulses consisting of frequency-divided pulses and said basic pulses, and said time difference $\Delta t$.

6. An ink pump control system as set forth in claim 5 wherein said predetermined pulse output section is adapted to generate predetermined pulses consisting of pulses arranged in the descending order of period, using said basic pulses and a plurality of types of said frequency-divided pulses having different periods.

7. An ink pump control system as set forth in claim 6 wherein said comparator section is included in said arithmetic section.

* * * * *